US006796342B2

(12) United States Patent
De Antoni Migliorati et al.

(10) Patent No.: US 6,796,342 B2
(45) Date of Patent: Sep. 28, 2004

(54) CONVEYING UNIT FOR CONTAINERS IN FILLING MACHINES

(75) Inventors: Narciso De Antoni Migliorati, Castiglione delle Stiviere (IT); Stefano Cavallari, Bologna (IT)

(73) Assignee: Azionaria Costruzioni Macchine Automatiche A.C.M.A. S.p.A., Bologna (IT)

( * ) Notice: Subject to any disclaimer, the term of this patent is extended or adjusted under 35 U.S.C. 154(b) by 0 days.

(21) Appl. No.: 10/194,942

(22) Filed: Jul. 15, 2002

(65) Prior Publication Data

US 2003/0136465 A1 Jul. 24, 2003

(Under 37 CFR 1.47)

(30) Foreign Application Priority Data

Jul. 19, 2001 (IT) ..... BO2001A0462

(51) Int. Cl.[7] ..... B65B 1/04
(52) U.S. Cl. ..... 141/165; 141/372; 198/470.1
(58) Field of Search ..... 198/803.7, 803.1, 198/470.1; 53/300; 141/165, 372

(56) References Cited

U.S. PATENT DOCUMENTS 4,023,513 A 5/1977 Dean
5,607,045 A 3/1997 Kronseder
5,711,411 A * 1/1998 Zurweller ..... 198/470.1
5,778,633 A 7/1998 Sweeny
6,302,172 B1 * 10/2001 De Villele ..... 141/372
6,354,427 B1 * 3/2002 Pickel et al. ..... 198/470.1

FOREIGN PATENT DOCUMENTS

GB 302043 12/1928
GB 1595159 8/1981

* cited by examiner

*Primary Examiner*—Steven O. Douglas
(74) *Attorney, Agent, or Firm*—Davidson Berquist Klima & Jackson, LLP

(57) ABSTRACT

Containers are conveyed through a carousel type filling machine by a plurality of grippers each comprising a bracket element, and a pair of jaws connected to the bracket element by way of relative pivots; the two jaws are joined one to another by a removable segment of elastic material positioned with two ends seated in corresponding sockets afforded by the jaws. During the steps in which the containers are taken up and subsequently released by the grippers, the two jaws rotate about the two pivots and are centered by a locating pin, the pivots, the pin and the bracket element all being molded in a single piece from plastic material.

20 Claims, 3 Drawing Sheets

CONVEYING UNIT FOR CONTAINERS IN FILLING MACHINES

BACKGROUND OF THE INVENTION

The present invention relates to a conveying unit for containers in filling machines.

The invention finds application to advantage in machines for filling containers both with liquid substances and with powder substances.

Such conveying units consist substantially of a main carousel rotatable about a vertical axis and supporting a supply tank containing the substances; the carousel receives a succession of containers each presenting a body and filler mouth, which are taken up at a first transfer station from a first rotary infeed conveyor.

The supply tank is equipped at the bottom with a plurality of filler valves, each of which can be associated with the mouth of a respective container in such a manner that when the carousel is set in motion, the tank rotates about the vertical axis and its contents are dispensed by way of the filler valves into the containers, whereupon the filled containers are directed by way of a second transfer station onto a second outfeed conveyor.

During the filling operation, more particularly, the containers revolve as one with the valves about the axis of rotation of the tank and are maintained in the correct filling position, that is to say, the filler mouth substantially in coaxial alignment with the relative valve, by a plurality of support and restraint assemblies. Each of these assemblies is equipped with two grippers, lower and upper, of which the relative jaws are positioned respectively to restrain the body and the neck of the individual container. More exactly, each gripper comprises a bracket element connected to a given point on the periphery of the main carousel, also a pair of jaws occupying a common plane and connected thus to the bracket element by way of relative pivots. The two jaws are interconnected by a spring of which the opposite ends are anchored to respective fixed pins rigidly associated with the jaws. The spring serves to maintain the two jaws in the gripping position, in which they combine to afford a seat proportioned to accommodate and restrain a part of the container body or the container neck, respectively. The edge profiles presented by the free ends of the jaws and by the contours of the seat are shaped according to the type and geometry of the container that is to be gripped: an expedient that serves, initially, to facilitate the take-up of the empty container into the seat during its transfer from the first infeed conveyor to the support and restraint assembly, and thereafter, to facilitate the release of the filled container during the course of its transfer from the support and restraint assembly to the second outfeed conveyor. Both the take-up movement and the release movement of the container are generated in a substantially radial direction, relative to the main carousel, overcoming the elastic force of the aforementioned spring, of which the tension will be appropriately calculated on a case by case basis.

Accordingly, it will be evident that the two jaws must remain permanently free to rotate about their respective pivots and that the spring likewise must maintain a correct tension over time, so that the take-up and release movements will always employ the same degree of force, otherwise the smooth operation of the machine could be jeopardized.

It is common practice with carousel type filling machines to obtain the long-term dependability in question by using pivots fashioned from special metallic materials and given a surface treatment such as will ensure durability from the structural standpoint, superior resistance to wear, and low friction, and likewise using a coil spring made of special material to ensure that its tension remains constant over time.

It has been found in practice, nonetheless, that the metal pivots of the gripper jaws tend to stray from their correct structural position and assume positions unable to guarantee smooth operation of the gripper over time; moreover, given the nature of the products being dispensed and the fact that these inevitably will come into contact with the metal components mentioned above, both the pivots and the coil springs of the grippers are attacked by the substances in question with the result that their operation is adversely affected. This means frequent servicing and/or frequent replacement of the affected parts, and correspondingly high costs.

The object of the present invention is to provide a unit for conveying containers, such as will be unaffected by the above drawbacks.

SUMMARY OF THE INVENTION

The stated object is realized according to the invention in a conveying unit for containers in filling machines, machines wherein the containers are held firm by a plurality of grippers each comprising a bracket element, a pair of jaws connected to the relative bracket element by way of corresponding pivots, and to advantage, at least one segment of elastic material connected separably by one end to at least one of the two gripper jaws through the agency of respective anchor means, said anchor means comprising: at least two knuckles fashioned integrally with the segment of elastic material, one at each end, at least two sockets afforded one by each gripper jaw serving to accommodate a respective knuckle end.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
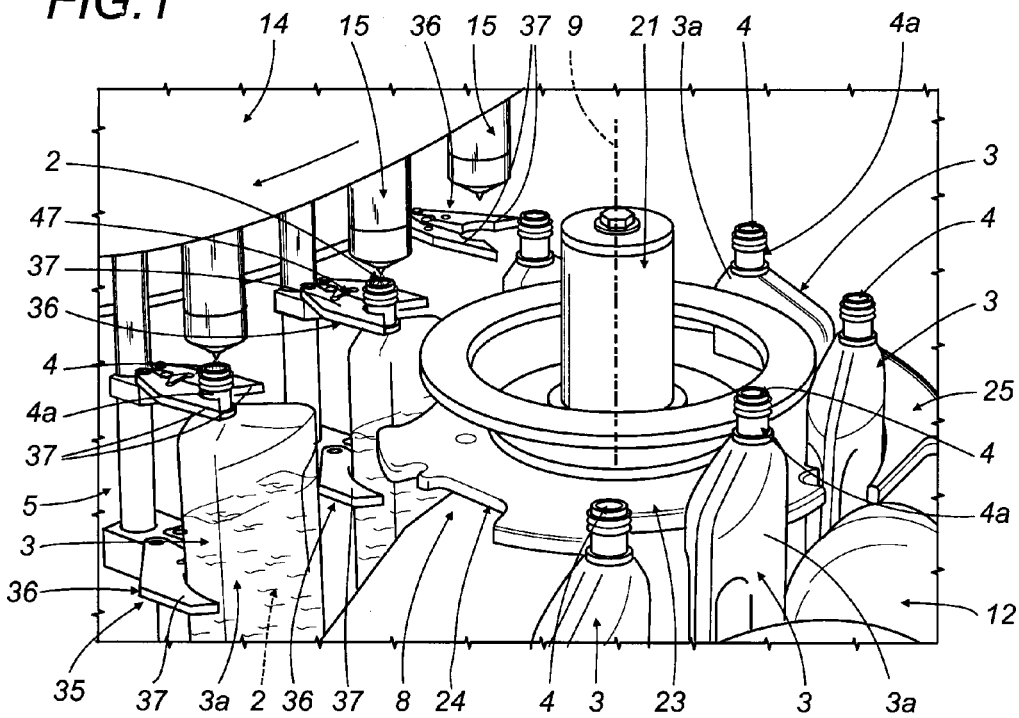
FIG. 1 shows a portion of a filling machine by which liquid and/or powder materials are dispensed into containers, illustrated schematically and in perspective.
Figure 2:
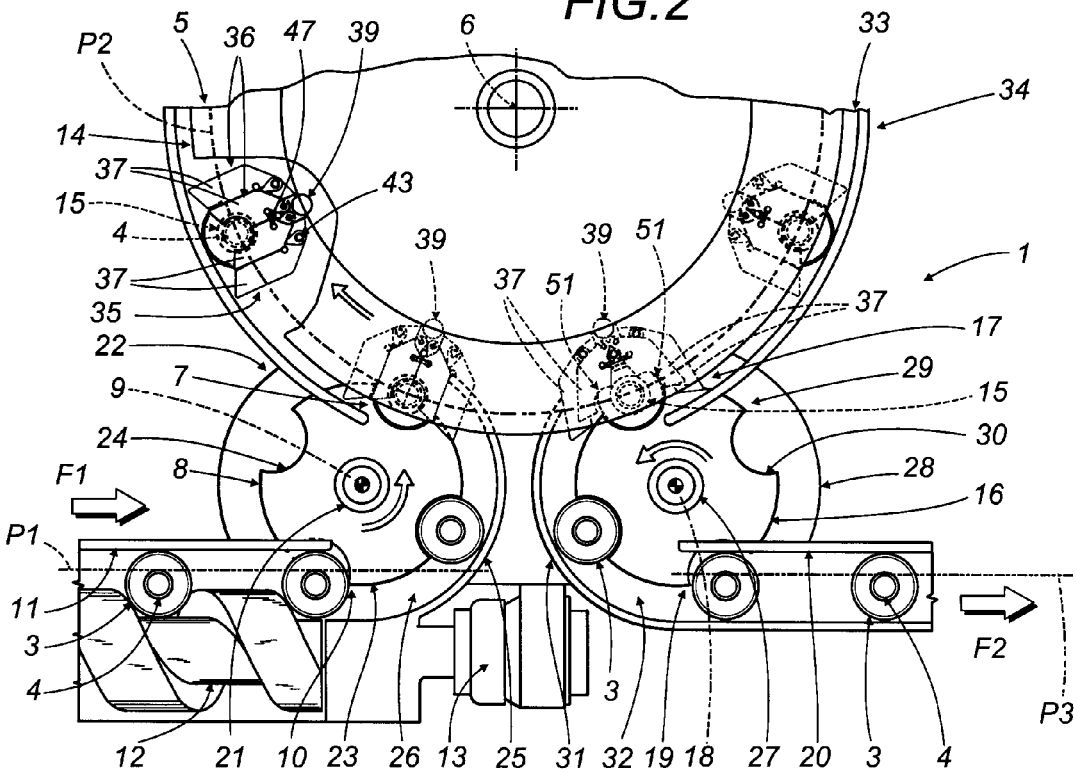
FIG. 2 shows the portion of the filling machine as in FIG. 1, illustrated in a plan view.

With reference to FIGS. 1 and 2 of the drawings attached, 1 denotes a portion, in its entirety, of a filling machine by which substances 2 of liquid or powder consistency are dispensed into single containers 3 each presenting a filler mouth 4.

The filling machine 1 comprises a main carousel 5 rotatable about a vertical axis 6, moving clockwise as viewed in FIGS. 1 and 2 and tangentially to a first transfer station 7 through which containers 3 are supplied to the main carousel singly and in succession by a rotary infeed conveyor 8.

The infeed conveyor 8 rotates counterclockwise as seen in FIGS. 1 and 2 about a vertical axis 9 parallel to the main axis 6, tangentially to a first infeed station 10 at which it receives a succession of containers 3 proceeding along a first predetermined path P1 afforded by a horizontally disposed infeed channel 11; the channel is equipped with a screw feeder 12 and a relative motor 13 by which the containers 3 are advanced intermittently toward the infeed station 10 along the first feed path P1 in a direction denoted F1.

The carousel 5 is disposed and embodied in such a way as to support the containers 3 and serves also to carry a tank 14, rigidly associated with the carousel and furnished with a plurality of filler valves 15 equispaced about the vertical axis 6 of rotation. The filler valves 15 are designed in such a way that each will assume a position of alignment above the mouth 4 of a relative container 3 as the tank 14 rotates about the axis 6, propelled by the carousel 5, allowing a quantity of the substance 2 contained in the tank to be dispensed into each of the single containers 3; the advancing containers 3 are caused at the same time to follow a second predetermined feed path P2 extending around the axis 6 of rotation, along which the filling step will take place, and once filled are released onto a rotary outfeed conveyor 16 by way of a second transfer station 17.

The outfeed conveyor 16 rotates counterclockwise as seen in FIG. 1 about an axis 18 parallel to the axis 6 of the carousel 5, and serves to direct the filled containers 3 from the second transfer station 17 through an outfeed station 19, thence into an outfeed channel 20 aligned with the infeed channel 11, along which they advance in a direction denoted F2 following a third predetermined path P3 toward a pickup unit not indicated in the drawings.

The infeed conveyor 8 comprises a shaft 21 placed concentrically with the respective axis 9, carrying a platform 22 at the bottom, and at least one disc element 23 uppermost that consists in a star wheel of conventional embodiment, presenting an ordered succession of peripheral recesses 24 each partially accommodating a relative container 3 standing on the platform 22. The conveyor 8 also comprises an external fence 25 combining with the periphery of the star wheel 23 to define a respective channel 26 along which the containers 3 pass from the infeed station 10 to the first transfer station 7.

In similar fashion to the infeed conveyor 8, the outfeed conveyor 16 comprises a shaft 27 disposed concentrically with the relative axis 18, carrying a platform 28 at the bottom and at least one star wheel element 29 uppermost presenting an ordered succession of peripheral recesses 30 each partially accommodating a relative container 3 standing on the platform 28. The conveyor 16 also comprises an external fence 31 combining with the periphery of the star wheel 29 to define a respective channel 32 along which the containers 3 pass from the second transfer station 17 to the outfeed station 19.

The aforementioned channels 26 and 32 are merged respectively with the infeed and outfeed ends of a filling channel 33 located beneath the tank 14 and extending along the second predetermined path P2, compassed on the one hand by the carousel 5 and on the other by a fence 34 concentric with the axis 6 of rotation.

As illustrated in FIGS. 1 and 2, the carousel 5 comprises a plurality of assemblies 35 associated one with each filler valve 15, by which a single container 3 is supported and restrained in such a way as to remain correctly positioned during the filling operation, that is to say with the mouth 4 substantially in coaxial alignment with the filler valve 15. Each assembly 35 comprises a platform at the bottom (not shown in the drawings) on which to stand the single container 3, and two grippers both denoted 36, lower and upper, serving respectively to retain the body 3*a* and the neck 4*a* of a single container 3 between their relative jaws 37.

Figure 3:
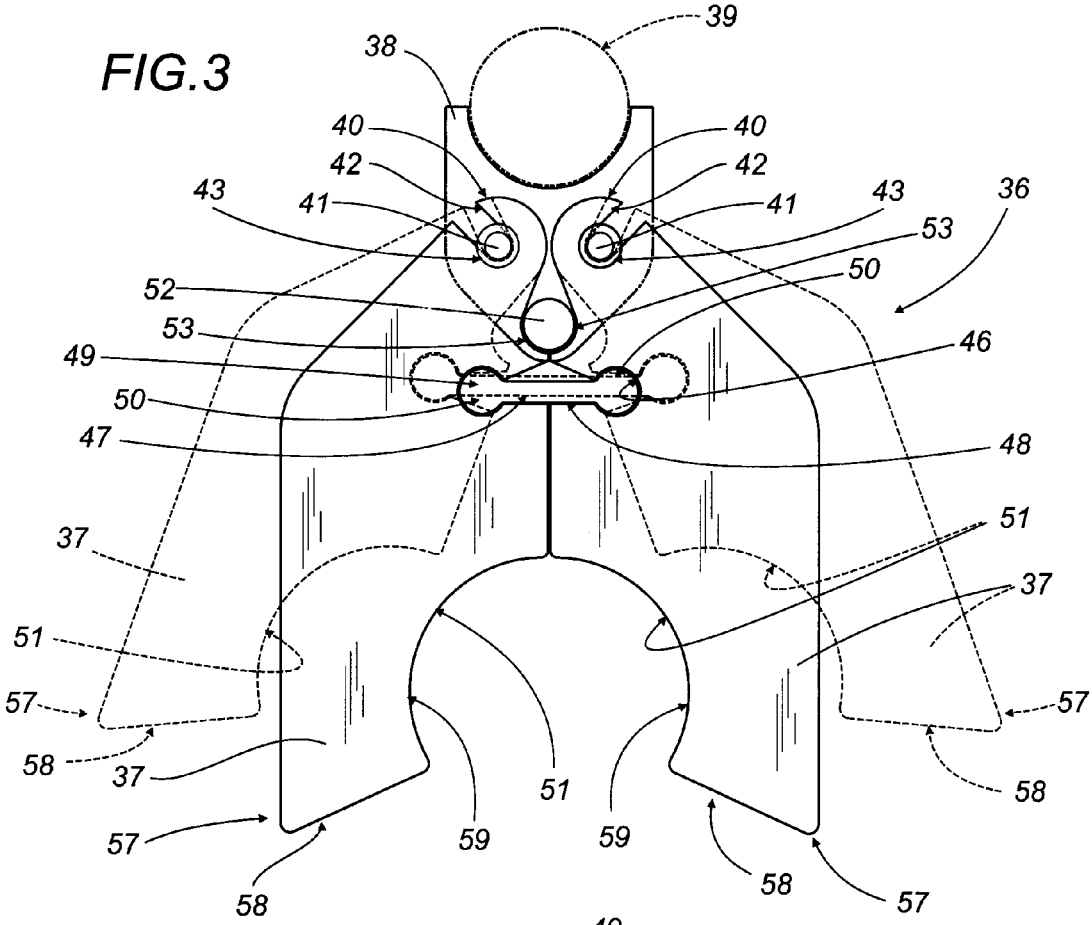
FIGS. 3 and 4 show a detail of FIG. 1, in plan and in an exploded view, respectively, illustrated in a first embodiment.
Figure 4:
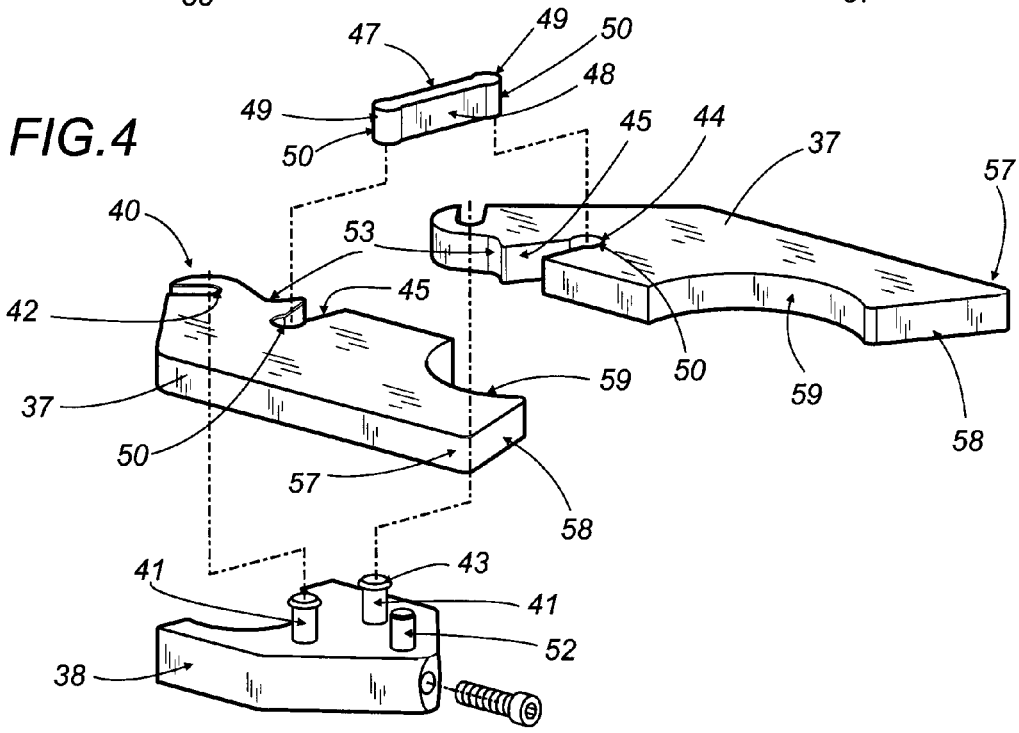

Referring to FIGS. 3 and 4, each gripper 36 incorporates a bracket element 38 connected to a vertical post 39 (FIGS. 1, 2 and 3) forming part of a relative support and restraint assembly 35 and disposed parallel to the axis 6 of the carousel 5, also a pair of jaws 37 occupying a common plane and connected each by one first end 40 to the bracket element 38 by way of a respective pivot 41. More exactly, each first end 40 presents a hole 42 open on one side as to allow quick assembly with the relative pivot 41, which in turn presents a head 43 of enlarged diameter affording a stop that ensures the jaw 37 cannot work free once assembled.

Each one of the two jaws 37 presents a socket 44 accessible from the periphery by way of a relative notch 45; the sockets 44 and the notches 45 of each gripper 36 combine when the relative jaws 37 occupy the closed position (indicated by solid lines in FIG. 3) to create a slot 46 such as will accept a segment 47 of elastic material presenting a central web 48 and two knuckle ends 49. The two ends 49 are proportioned to locate in the relative sockets 44 with a degree of interference, whilst the web 48 occupies the two notches 45.

More exactly, the two knuckle ends 49 and the respective sockets 44 constitute means 50 by which the segment 47 of elastic material is anchored to the jaws 37 as the jaws are drawn by the selfsame segment into the closed position (indicated by the solid lines in FIG. 3), in which they combine to afford an arcuate seat 51 partially accommodating and gripping the body 3*a* or neck 4*a* of the single container 3. The bracket element 8 also comprises a locating pin 52 positioned between the pivots 41 and the slot 46, which is interposed between the jaws 37 in such a way as to register with matching recesses 53 fashioned in the selfsame jaws 37 and thus ensure that these are disposed symmetrically when in the closed position.

In particular, the segment 47 of elastic material is obtained by extruding a continuous section and then cutting transversely through the section; the operation of fitting the segment into the slot 46 is accomplished with notable ease, as likewise is its removal from the slot. Both the pivots 41 and the pin 52 are embodied integrally with the bracket element 38 which can be fashioned, for example, in molded plastic.

Figure 5:
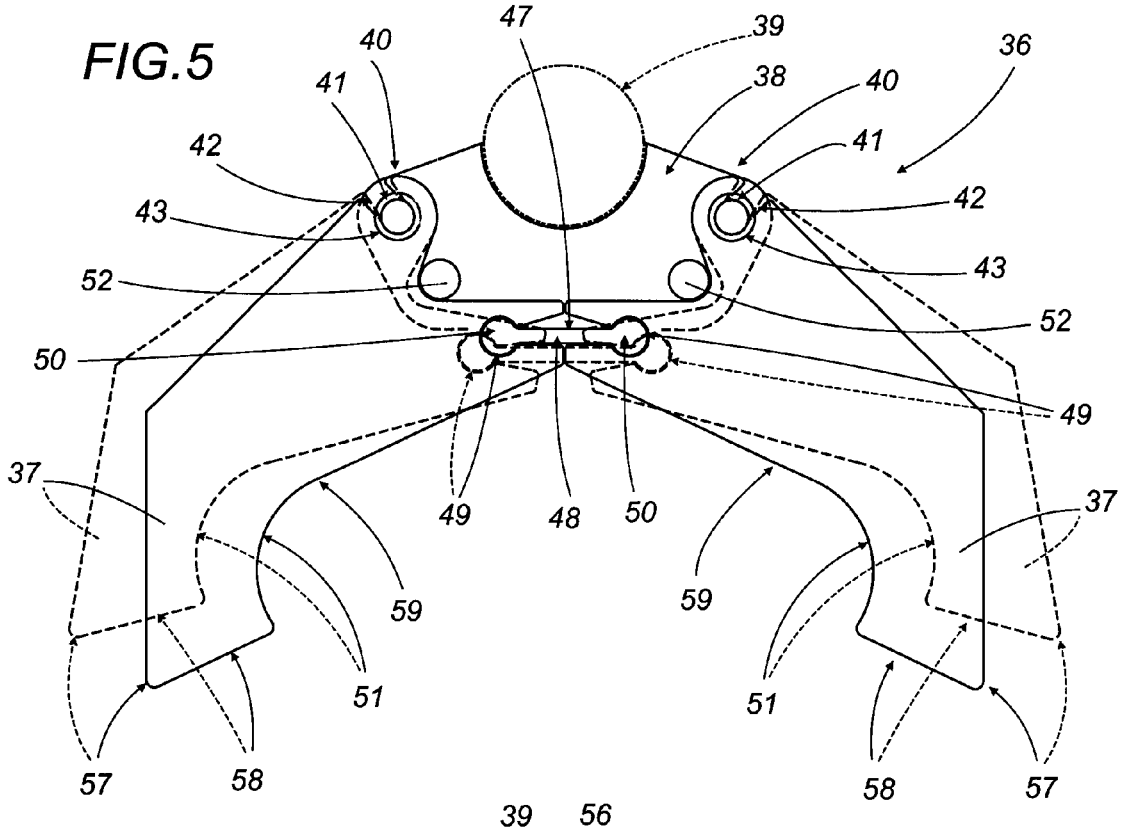
FIGS. 5 and 6 show the detail of FIG. 3 viewed in plan and illustrated in two further embodiments.
Figure 6:
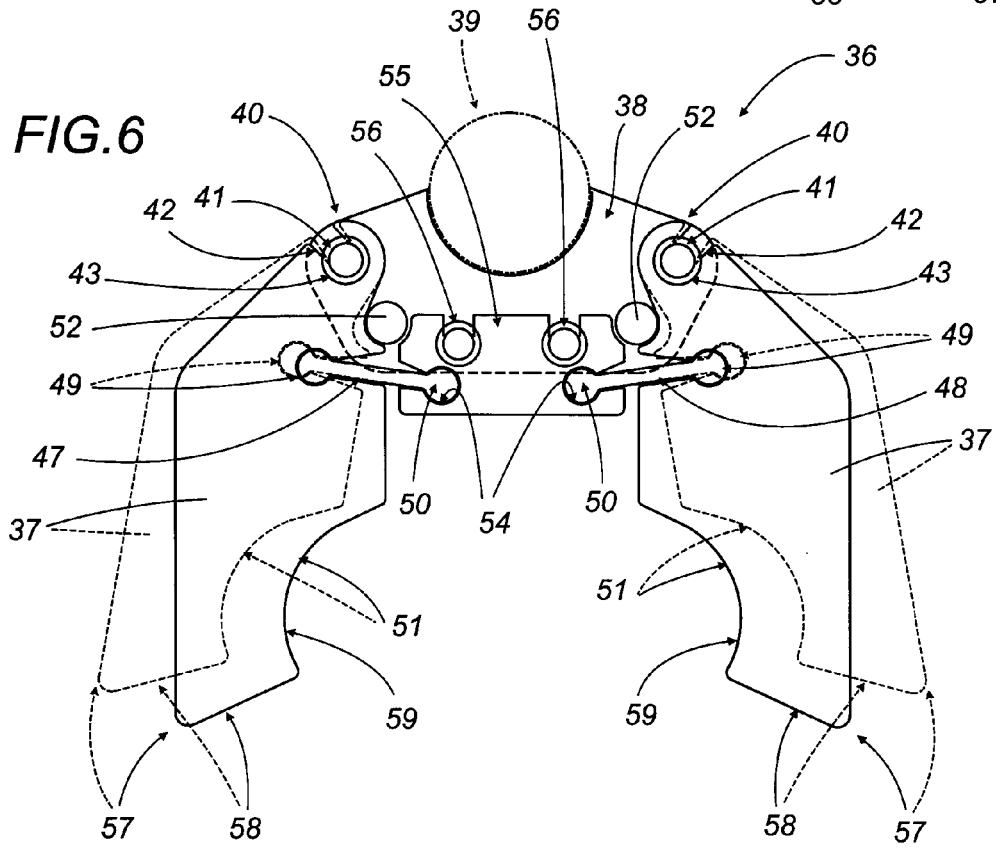

More precisely, the gripper shown in FIGS. 3 and 4 is designed in particular to accommodate the neck 4*a* of a single container 3 in the seat 51 afforded by the relative jaws 37, whereas the two grippers 36 of FIGS. 5 and 6 are designed each to accommodate the body 3*a* of a single container 3 in the seat 51 afforded by the relative jaws 37. The gripper of FIG. 5 differs from that of FIG. 3 only inasmuch as the bracket element 38 presents two locating pins 52, each designed to register with a respective recess 53 afforded by the jaw 37, whilst the gripper of FIG. 6 differs from those of the other drawings in that it comprises not only two locating pins 52 but also two segments 47 of elastic material. In this particular instance, each such segment 47 is disposed with one knuckle end 49 occupying the relative socket 44 of one jaw 37 and the other end 49 occupying a respective socket 54 afforded by a connecting plate 55 secured to the bracket element 38 with two anchor pins 56.

To advantage, the profiles of the free ends 57 presented by the two jaws 37, denoted 58, and the profiles of the edges presented by the seat 51, denoted 59, will be shaped according to the type and geometry of the container 3 and according to the part of the container 3 they are required to grip, namely the body 3*a* or the neck 4*a*, thereby facilitating the take-up and subsequent release of the container by the grippers 36.

In operation, referring to FIGS. 1 and 2, the container is taken up into the seats 51 afforded by the grippers 36 at the first transfer station 7 as the container 3 passes from the first conveyor 8 to the relative support and restraint assembly 35 of the carousel 5. During the course of this transfer, the container 3 is subjected to a pushing action in a substantially radial direction, relative to the carousel 5, with the result that it bears against the aforementioned end profiles 58 and forces the jaws 37 to open. The jaws 37 thus rotate about the two pivots 41 to the point of assuming the spread position indicated by phantom lines in FIGS. 3, 5 and 6, overcoming the resistance of the segment 47 of elastic material which consequently extends, allowing the container 3 to locate in the seat 51, then retracts so that the container is restrained in the selfsame seat 51.

On reaching the end of the feed path P2 followed along the filling channel 33, the container 3 will be released from the seat 51 of the gripper 36 at the second transfer station 17 and pass from the support and restraint assembly 35 of the carousel 5 to the outfeed conveyor 16. During the course of this transfer, the container 3 is subjected to a pushing action in a substantially radial direction relative to the assembly 35, equal and opposite to that of the infeed movement, with the result that it will bear against the edge profiles 59 of the seat 51 and force the gripper jaws 37 to open. The jaws 37 thus rotate about the two pivots 41 to the point of assuming the spread position indicated by phantom lines in FIGS. 3, 5 and 6, overcoming the resistance of the segment 47 of elastic material which consequently extends, so that the container 3 is able to abandon the seat 51.

It will be clear that the notion of embodying the bracket element 38 integrally with the pivots 41 and pins 52 is instrumental in reducing the number of components and improving the mechanical strength of the selfsame pivots, besides cutting production costs. It will be seen also that lubrication is no longer necessary, and that the segment of elastic material can be replaced at decidedly minimal cost, compared to the coil springs and anchor pins of prior art solutions. Moreover, the plastic material utilized to make both the bracket element and the segment of elastic material has been found to be affected neither by the substances being batched, nor by the substances containing detergents and disinfectants used typically to clean the conveying unit. This further advantage also guarantees longer life of the conveying unit, which requires less maintenance and is characterized by lower operating costs.

What is claimed is:

1. A conveying unit for containers in filling machines wherein the containers are held firm by a plurality of grippers each comprising:

a bracket element, a pair of jaws connected to the relative bracket element by way of corresponding pivots, at least one segment of elastic material connected separably by one end to at least one of the two gripper jaws through the agency of respective anchor means, said anchor means comprising:

at least two knuckles fashioned integrally with the segment of elastic material, one at each end, and at least two sockets afforded one by each gripper jaw serving to accommodate a respective knuckle end.

2. A unit as in claim 1, wherein the segment of elastic material is connected by a second end and through the agency of the anchor means to the other gripper jaw.

3. A unit as in claim 1, wherein the segment of elastic material is connected by a second end and through the agency of the anchor means to the bracket element.

4. A unit as in claim 3, wherein the anchor means comprise a socket afforded by the bracket element and serving to accommodate the relative knuckle end of the segment of elastic material.

5. A unit as in claim 4, wherein the anchor means comprise a connecting plate associated with the bracket element by way of respective anchor pins and affording respective sockets serving each to accommodate the relative knuckle end of the segment of elastic material.

6. A unit as in claim 1, wherein the pivots are embodied integrally with the bracket element.

7. A unit as in claim 1, comprising at least one locating pin interposed between the gripper jaws, positioned intermediately between the pivots and the segment of elastic material, and embodied integrally with the bracket element.

8. A unit as in claim 1, wherein said bracket element is all embodied in plastic material.

9. A unit as in claim 5, wherein said connecting plate is all embodied in plastic material.

10. A unit as in claim 7, wherein said at least one locating pin is all embodied in plastic material.

11. A conveying unit for containers in filling machines wherein the containers are held firm by a plurality of grippers each comprising:

a bracket element, a pair of jaws connected to the relative bracket element by way of corresponding pivots, at least one segment of elastic material connected separably by one end to at least one of the two gripper jaws through the agency of respective anchor means, and at least one locating pin interposed between the gripper jaws, positioned intermediately between the pivots and the segment of elastic material, and embodied integrally with the bracket element.

12. A unit as in claim 11, wherein the segment of elastic material is connected by a second end and through the agency of the anchor means to the other gripper jaw.

13. A unit as in claim 11, wherein the segment of elastic material is connected by a second end and through the agency of the anchor means to the bracket element.

14. A unit as in claim 13, wherein the anchor means comprise a socket afforded by the bracket element and serving to accommodate the relative knuckle end of the segment of elastic material.

15. A unit as in claim 14, wherein the anchor means comprise a connecting plate associated with the bracket element by way of respective anchor pins and affording respective sockets serving each to accommodate the relative knuckle end of the segment of elastic material.

16. A unit as in claim 4, wherein the pivots are embodied integrally with the bracket element.

17. A unit as in claim 11, comprising at least one locating pin interposed between the gripper jaws, positioned intermediately between the pivots and the segment of elastic material, and embodied integrally with the bracket element.

18. A unit as in claim 11, wherein said bracket element is all embodied in plastic material.

19. A unit as in claim 15, wherein said connecting plate is all embodied in plastic material.

20. A unit as in claim 17, wherein said at least one locating pin is all embodied in plastic material.

* * * * *